US007165768B2

(12) United States Patent
Fang et al.

(10) Patent No.: US 7,165,768 B2
(45) Date of Patent: Jan. 23, 2007

(54) VARIABLE THREE-DIMENSIONAL LABYRINTH

(76) Inventors: Chih-Chung Fang, No. 566, Chung Hua Road, Pa Te, Taoyuan Hsien (TW); Ying-Jen Chen, No. 566, Chung Hua Road, Pa Te, Taoyuan Hsien (TW)

( * ) Notice: Subject to any disclaimer, the term of this patent is extended or adjusted under 35 U.S.C. 154(b) by 0 days.

(21) Appl. No.: 11/099,630

(22) Filed: Apr. 6, 2005

(65) Prior Publication Data

US 2006/0226600 A1 Oct. 12, 2006

(51) Int. Cl.
*A63F 9/08* (2006.01)

(52) U.S. Cl. ..... 273/153 S

(58) Field of Classification Search ..... 273/153 R, 273/153 S, 109, 113, 118 R, 123 R
See application file for complete search history.

(56) References Cited

U.S. PATENT DOCUMENTS 3,749,405 A * 7/1973 Grattoni ..... 273/153 R
4,861,036 A * 8/1989 Watanabe ..... 273/113
4,953,863 A * 9/1990 Zeidler et al. ..... 273/113
6,139,015 A * 10/2000 Hsieh ..... 273/153 R
6,241,248 B1 * 6/2001 Winter ..... 273/153 S
6,523,825 B1 * 2/2003 Francis ..... 273/153 R
6,568,679 B1 * 5/2003 Sommer ..... 273/153 R

* cited by examiner

*Primary Examiner*—Steven Wong
(74) *Attorney, Agent, or Firm*—Troxell Law Office, PLLC

(57) ABSTRACT

A variable three-dimensional labyrinth comprises a base, a plurality of central blocks, side blocks, corner blocks, wherein a plurality of buckling pillars are mounted on the base for buckling the central blocks. A plurality of hollow tunnels are formed on the central blocks, the side blocks, and the corner blocks. A holding part is mounted on each central block. A pivotally connecting part is integrated with each side block and each corner block. The pivotally connecting part is pivotally mounted between the base and the central blocks. A ball is moved into the hollow tunnels of the blocks from an entrance hole and moved along the hollow tunnels by rotating the blocks until reaching an exit hole, wherein the exit hole is formed on an exterior surface of one of the blocks, and the entrance hole is formed on an exterior surface of another block.

8 Claims, 9 Drawing Sheets

VARIABLE THREE-DIMENSIONAL LABYRINTH

FIELD OF THE INVENTION

The present invention relates to an intelligence toy, and more particularly to a variable three-dimensional labyrinth having tunnels, wherein the directions of tunnels are changed by rotation of the blocks so as to provide a way out for the ball and increase the challenge and the interest.

BACKGROUND OF THE INVENTION

Initially, the conventional magic block provides a 3×3×3 structure (i.e. a cube structure with 3×3 blocks on its each surface so it has a total of 26 blocks on its six surfaces). These blocks are rotated around their center to change their positions. Subsequently, a 4×4×4 magic block and a 5×5×5 magic block are developed. However, the playing methods of these conventional magic blocks only offer the ability to rearrange the original integrated color or pattern before finding a way to recover this original integrated color or pattern. The absence of the conception of three-dimensions usually makes the player lose his confidence and patience and not want to continuously play the magic block after he rotates these blocks several times. Therefore, the player always discards this kind of magic block because they lose interest. In view of the above-mentioned drawbacks, the present invention improves the structure of the conventional magic block and provides a variable three-dimensional labyrinth with brand-new playing methods.

SUMMARY OF THE INVENTION

It is a main object of the present invention to provide a variable three-dimensional labyrinth comprising central blocks, side blocks, and corner blocks. The blocks are contacted with one another and allowed to change their positions, and no leak is formed on the peripheries of the blocks. By means of these features, the openings of the hollow tunnels can be formed on upper, lower, left, or right portions of the sidewalls of the blocks. These hollow tunnels may or may not be equipped with passageways, wherein the passageways smooth the moving of the ball. Besides, an entrance hole is formed on one of the blocks, and an exit hole is formed on another block. When the ball enters the entrance hole, the player must rotate the blocks to find the connected passageways to move the ball into another block. Because the openings of the hollow tunnels of the blocks are confined to their predetermined locations, only one path leads the ball to the exit hole. Accordingly, it is full of challenge and interest. Moreover, when the player plays the variable three-dimensional labyrinth, he just needs to concentrate his attention on the moving direction of the ball without being puzzled by other blocks so as to avoid confusion and discouragement. Accordingly, this toy is full of challenge and interest, and does not make the player easily lose his confidence and patience. Due to the feature of the structure, when the player plays the variable three-dimensional labyrinth one time, the obtained new path is different from the original one. Accordingly, a totally different path is provided for the player each time the player plays this variable three-dimensional labyrinth. According to the mathematical calculation, hundreds of billions of changes are provided so the player will never feel boring.

It is another object of the present invention to provide a cube-shaped, a sphere-shaped, or a cylinder-shaped variable three-dimensional labyrinth. Regarding the playing methods, the blocks can be rotated one by one to find the way out. Alternatively, an integrated path can be formed first, and then the ball is moved straight from the entrance hole to the exit hole. As a result, one continuous line or other pattern may be formed in accordance with the predetermined positions of the openings. The variation of this variable three-dimensional labyrinth is quite great so it is full of challenge.

The present invention comprises the following structural features in which:

1. The three-dimensional labyrinth is preferably in the form of a sphere, a cube, or a pillar (e.g. a cylinder, an octagonal pillar, etc.).

2. The three-dimensional labyrinth is transparent or semi-transparent so as to distinctly observe the hollow tunnels and the position of the ball.

3. The blocks have the hollow tunnels, wherein the openings are formed on the adjacent sidewalls of the blocks or the sliding passageways are formed in the hollow tunnels to smooth the moving of the ball.

4. The ball is designed to have different shapes.

5. The blocks of the variable three-dimensional labyrinth can be rotated one by one to find the way out. Alternatively, an integrated path can be formed first, and then the ball is moved straight from the entrance hole to the exit hole. As a result, one continuous line or other pattern is formed. The path of the variable three-dimensional labyrinth is totally changed in accordance with the rotation of the blocks. According to the mathematical calculation, the variable three-dimensional labyrinth can provide hundreds of billions of playing methods.

Other objects and features of the present invention will become apparent from the following detailed description when taken in conjunction with the drawings in which:

DETAILED DESCRIPTION OF THE PREFERRED EMBODIMENT

The above-mentioned features and advantages of this invention, and the manner of attaining them, will become more apparent and the invention will be better understood by reference to the following description of embodiments of the invention taken in conjunction with the drawings.

Figure 10:
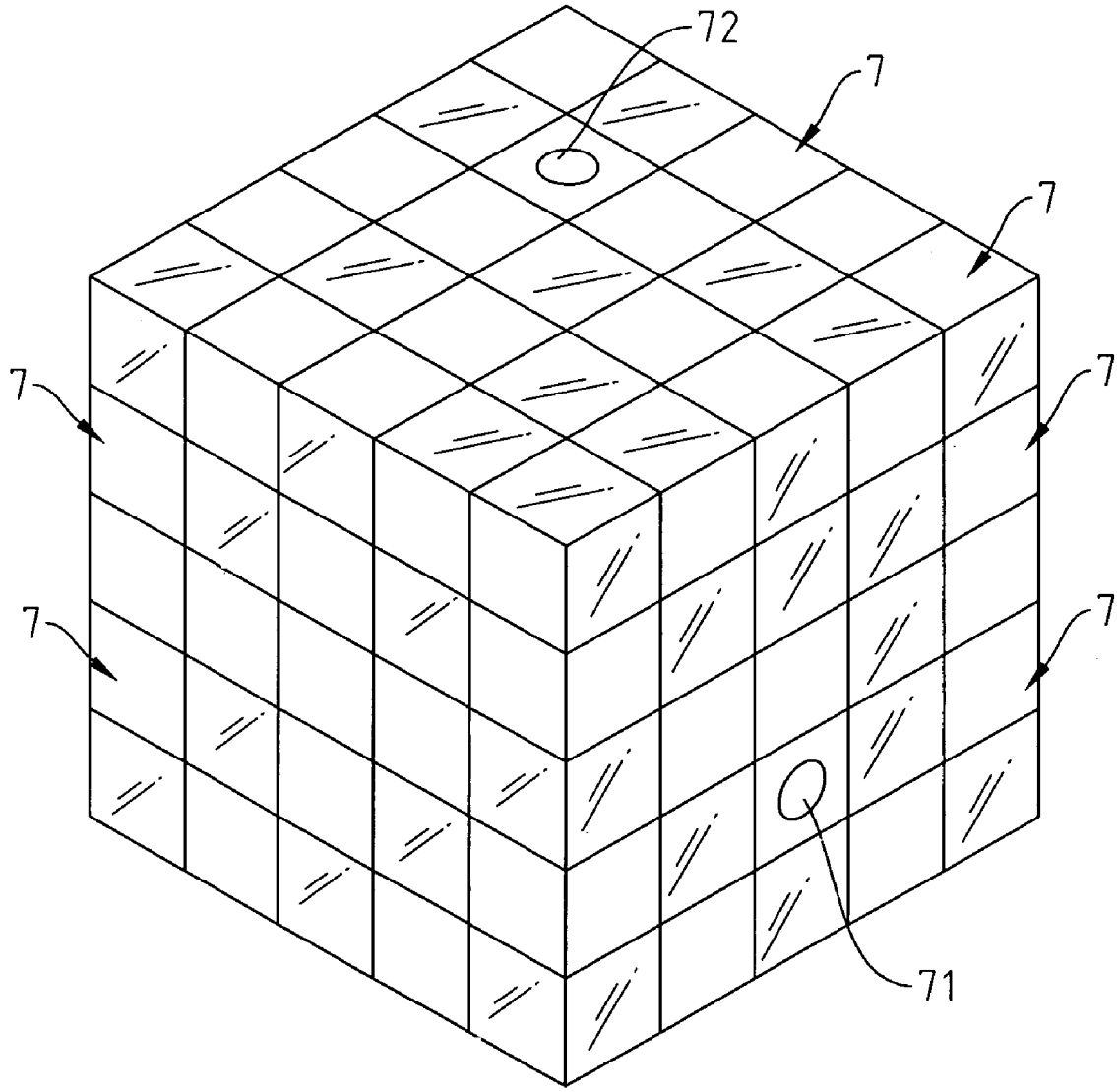
FIG. 10 is an elevational view showing a cube-shaped variable three-dimensional labyrinth of the present invention.
Figure 11:
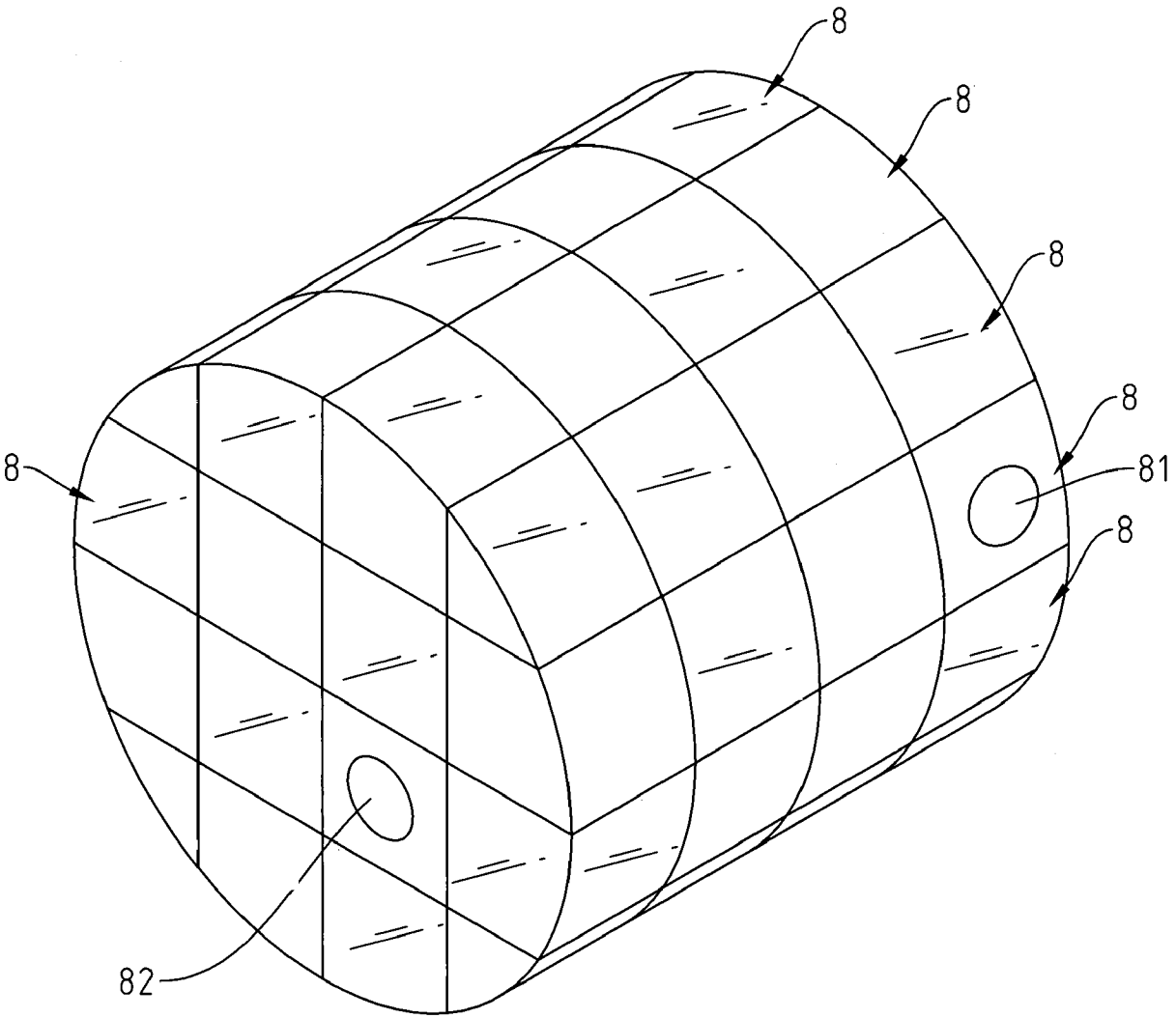
FIG. 11 is an elevational view showing a cylinder-shaped variable three-dimensional labyrinth of the present invention.

Referring to FIG. 1, FIG. 2, FIG. 9, and FIG. 11, a variable three-dimensional labyrinth of the present invention comprises a base 1, a plurality of central blocks 2, a plurality of side blocks 3, and a plurality of corner blocks 4. A plurality of anti-slip patterns 6 for providing the friction force are further formed on the surface of the variable three-dimensional labyrinth to avoid occurrence of slip during rotation of the blocks. The variable three-dimensional labyrinth is in the form of a sphere (shown in FIG. 1), a cube having an exit hole 71 and an entrance hole 72, which is composed of a plurality of blocks 7 (5×5×5, as shown in FIG. 10), a cylinder having an exit hole 81 and an entrance hole 82, which is composed of a plurality of blocks 8 (shown in FIG. 11), an octagonal pillar, etc.

In order to distinctly observe the hollow tunnels and the ball 5 during the moving of the ball 5, these blocks are designed to be transparent or semi-transparent.

Figure 1:
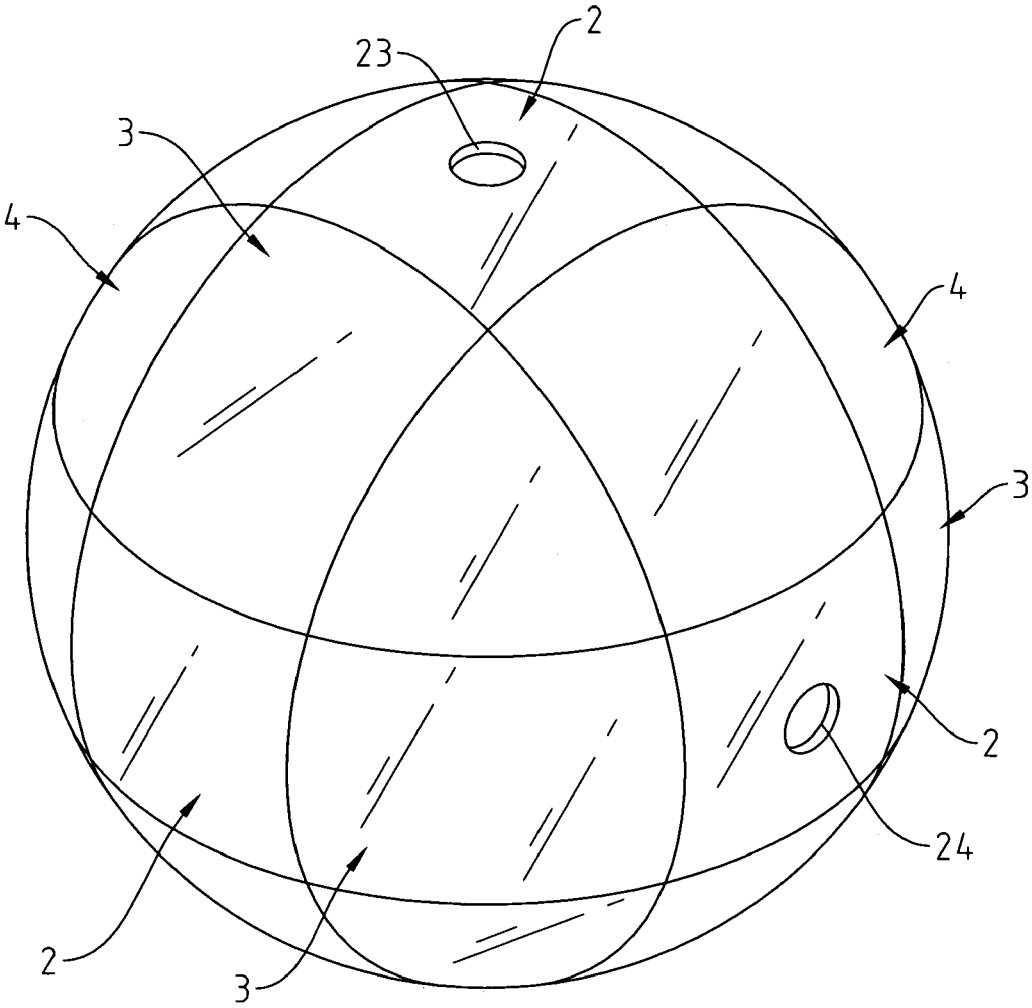
FIG. 1 is an elevational view of the present invention.
Figure 2:
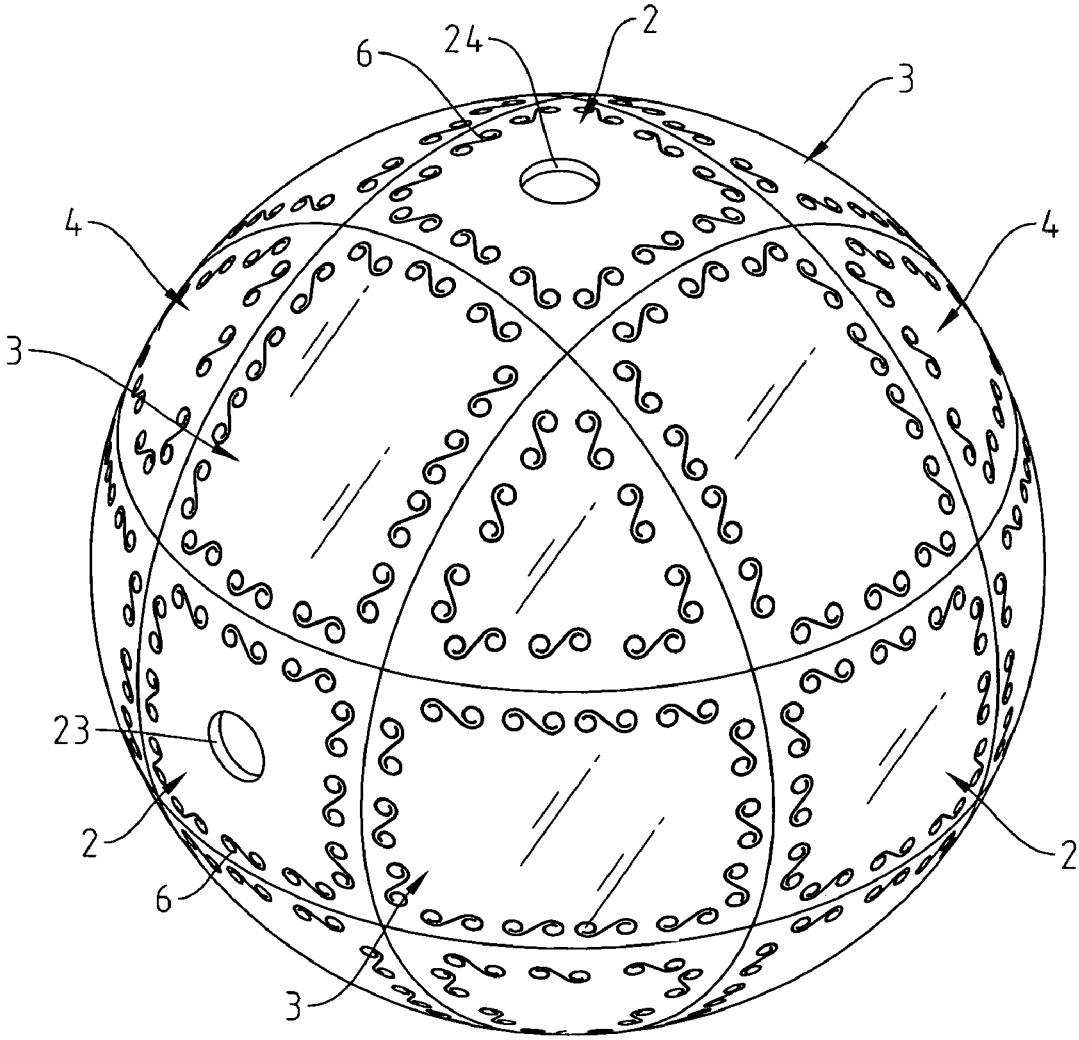
FIG. 2 is another elevational view of the present invention.
Figure 3:
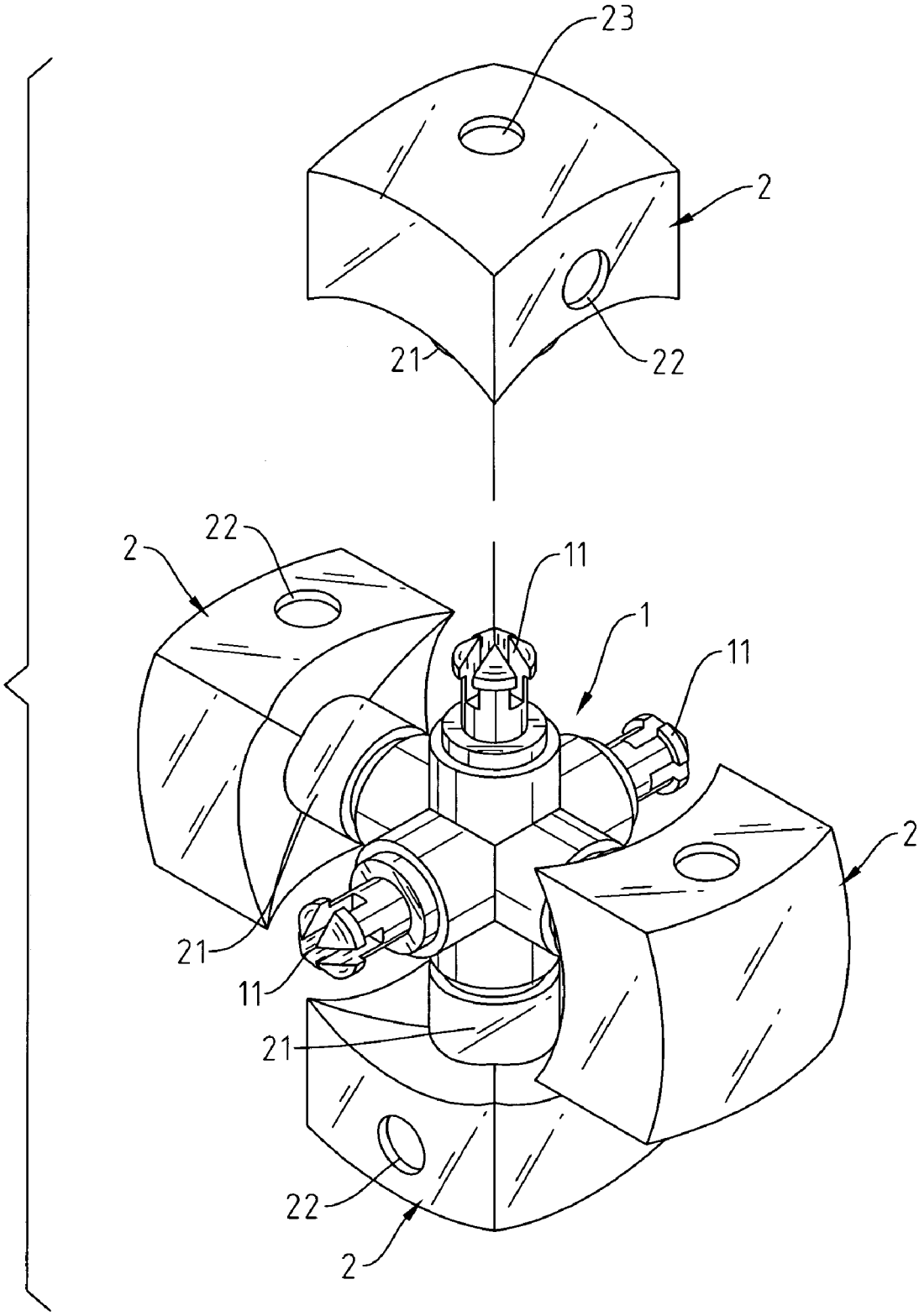
FIG. 3 is an elevational view showing the inside of the present invention.
Figure 4:
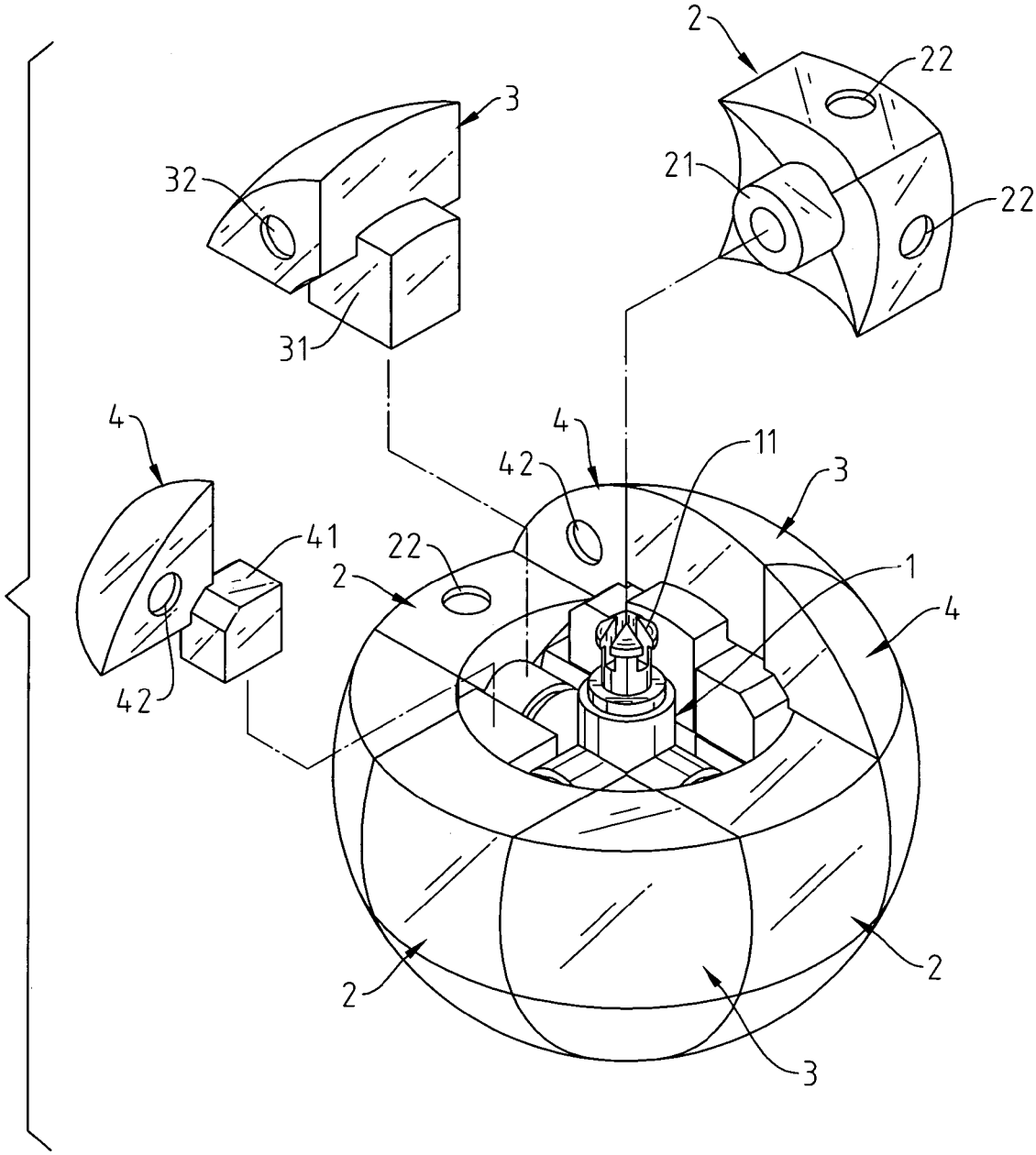
FIG. 4 is an elevational exploded view showing the components of the present invention.
Figure 5:
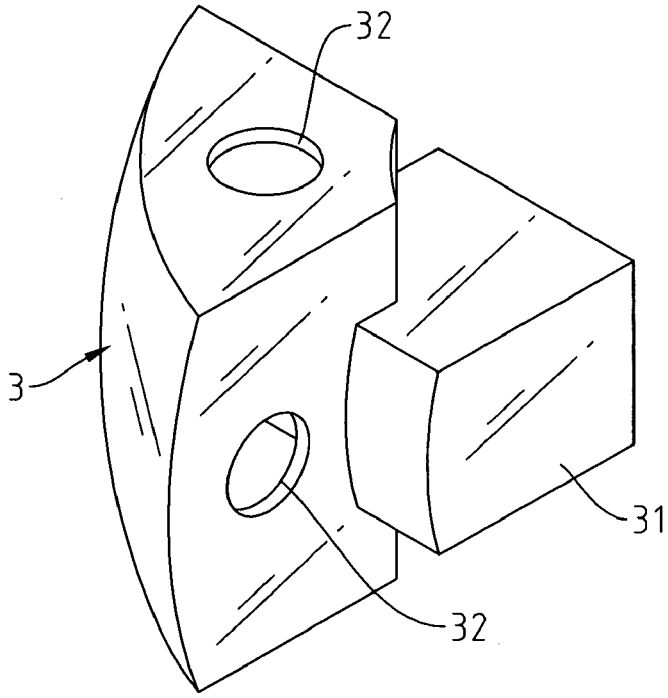
FIG. 5 is an elevational view showing the side block of the present invention.
Figure 6:
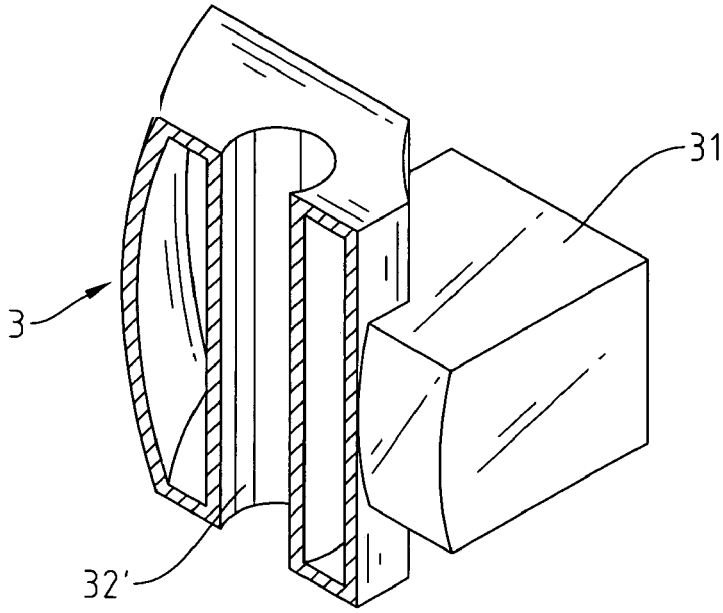
FIG. 6 is a schematic cross-sectional view showing the side block with the passageway in accordance with the present invention.
Figure 7:
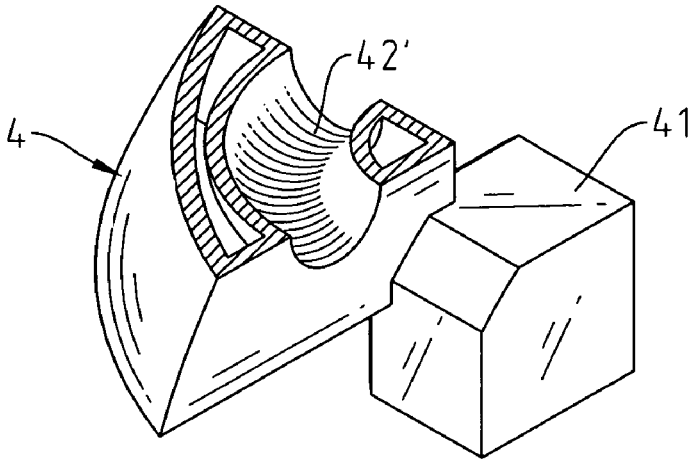
FIG. 7 is a schematic cross-sectional view showing the corner block with the passageway in accordance with the present invention.
Figure 8:
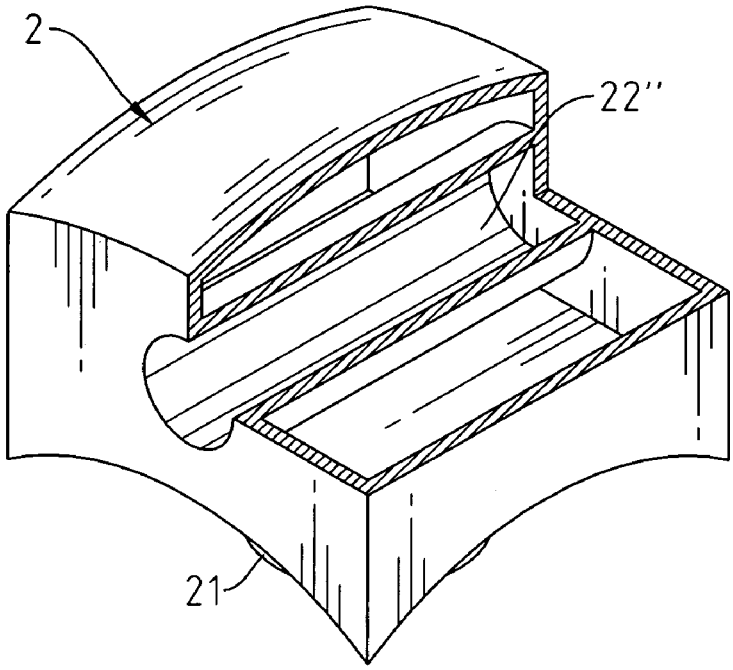
FIG. 8 is a schematic cross-sectional view showing the central block with a single opening in accordance with the present invention.
Figure 9:
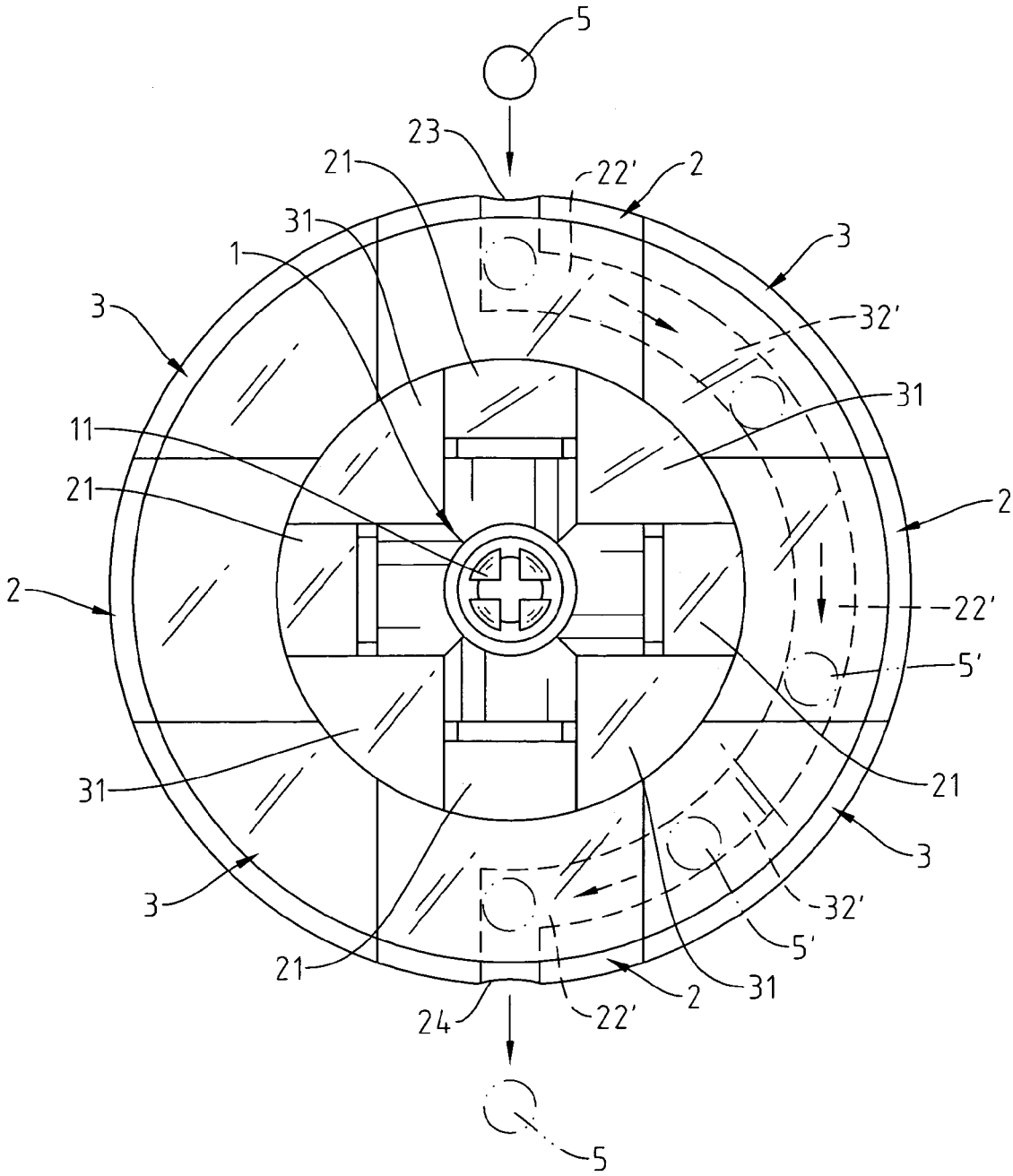
FIG. 9 is a schematic view showing the passageways and the moving path of the ball in accordance with the present invention.

A plurality of buckling pillars 11 are mounted on the outside of the base 1 for mounting the central blocks 2. A holding part 21 and a hollow tunnel 22 are formed on each central block 2 for holding the end of each buckling pillar 11 and positioning the buckling pillar 11 such that the base 1 and the central blocks 2 jointly constitute the fixed basic structure of the three-dimensional labyrinth and can not be rotated. An exit hole 23 is formed on the exterior surface of one of the central blocks 2. An entrance hole 24 is formed on the exterior surface of another central block 2. The hollow tunnels 22 can be formed inside the central blocks 2, and the hollow tunnels 22 further includes at least two openings on the lateral surfaces of the central blocks 2. Besides, when the central block 2 only has a single opening (referring to FIG. 8), a trap is therefore formed in a hollow tunnel 22' to prohibit the ball 5 from pass so the ball 5 must make a detour. As a result, the interest is increased.

In addition to the central blocks 2, it is certainly that the side blocks 3 and the corner blocks 2 can also be varied to equip with a single hole that acts a trap.

Referring to FIG. 3 through FIG. 5, and FIG. 9, when all of the central blocks 2 are coupled with the base 1, the space for mounting the side blocks 3 and the corner blocks 4 is formed and surrounded by the central blocks 2. A hollow tunnel 32 is formed on each side block 3 to penetrate through it, and a pivotally connecting part 31 is integrated with this side block 3. The pivotally connecting part 31 is pivotally mounted in the space between the base 1 and the central blocks 2. A hollow tunnel 42 is formed on each corner block 4 to penetrate through it, and a pivotally connecting part 41 is integrated with this corner block 4. The pivotally connecting part 41 is pivotally mounted in the space between the base 1 and the central blocks 2.

Accordingly, both the side blocks 3 and the corner blocks 4 are coupled with the central blocks 2, wherein these blocks are rotatable by use of the gaps formed therebetween. The blocks are contacted with one another and allowed to change their positions, and no leak is formed on the peripheries of the blocks. By means of these features, the openings of the hollow tunnels 22, 32, 42 can be formed on upper, lower, left, or right portions of the sidewalls of the blocks in accordance with the predetermined paths to smooth the moving of the ball 5. A trap is formed on the side blocks 3, corner blocks 4, and the central blocks 2 when they only equip with a single opening 22". This trap is exemplified in the FIG. 8. The central block 2 of this figure only includes an opening on one of its sidewalls to form the trap and to prevent the ball 5 from pass. Accordingly, when the ball 5 enters the central block 2 having one opening 22', it cannot roll forward into another block via this opening 22'. In order to allow the ball 5 to enter another hollow tunnel 22, 32, or 42, the ball 5 must get out of the central block 2 from this opening 22' where the ball 5 enters.

Referring further to FIG. 4 through FIG. 7, and FIG. 9, the central blocks 2, the side blocks 3, and the corner blocks 4 have the hollow tunnels 22, 32, and 42, respectively. Furthermore, the central blocks 2, the side blocks 3, and the corner blocks 4 respectively include passageways 22', 32', 42' to smooth the passing of the ball 5.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

The invention claimed is:

1. A variable three-dimensional labyrinth comprising:

a base;

a plurality of buckling pillars mounted on the outside of the base;

a plurality of central blocks, each central block having at least an opening and comprising: a hollow tunnel; and a holding part for holding an end of the buckling pillar;

a plurality of side blocks, each side block having at least an opening and comprising: a hollow tunnel; and a pivotally connecting part integrated with the side block, the pivotally connecting part being pivotally mounted between the base and the central blocks;

a plurality of corner blocks, each corner block having at least an opening and comprising: a hollow tunnel; and a pivotally connecting part integrated with the corner block, the pivotally connecting part being pivotally mounted between the base and the central blocks; and a ball for entering the hollow tunnels of the blocks from an entrance hole to move the ball along the hollow tunnels by rotating the blocks until reaching an exit hole, wherein the exit hole is formed on an exterior surface of one of the blocks, and the entrance hole is formed on an exterior surface of another block.

2. The variable three-dimensional labyrinth of claim 1, wherein the central blocks, the side blocks, and the corner blocks are transparent or semi-transparent.

3. The variable three-dimensional labyrinth of claim 1, wherein the tunnels penetrate through the central blocks, the side blocks, and the corner blocks.

4. The variable three-dimensional labyrinth of claim 1, wherein the tunnels of the central blocks, the side blocks, and the corner blocks further comprise a plurality of single opening tunnels.

5. The variable three-dimensional labyrinth of claim 1, further comprising a plurality of anti-slip patterns on the surfaces of the central blocks, the side blocks, and the corner blocks.

6. The variable three-dimensional labyrinth of claim 1, wherein the variable three-dimensional labyrinth is in the form of a sphere.

7. The variable three-dimensional labyrinth of claim 1, wherein the exit hole is formed on the central block, the side block, or the corner block.

8. The variable three-dimensional labyrinth of claim 1, wherein the entrance hole is formed on the central block, the side block, or the corner block.

* * * * *